US007390201B1

(12) United States Patent
Quinby et al.

(10) Patent No.: US 7,390,201 B1
(45) Date of Patent: Jun. 24, 2008

(54) DATA PORT SECURITY LOCK

(75) Inventors: Joseph D. Quinby, Albuquerque, NM (US); Clarence S. Hall, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 11/133,869

(22) Filed: May 19, 2005

(51) Int. Cl.
*H01R 13/44* (2006.01)

(52) U.S. Cl. ..... 439/133; 439/353

(58) Field of Classification Search ..... 439/133, 439/353, 357
See application file for complete search history.

(56) References Cited

U.S. PATENT DOCUMENTS

| | | | | |
|---|---|---|---|---|
| 5,104,330 | A * | 4/1992 | Yagi et al. | 439/157 |
| 6,071,141 | A * | 6/2000 | Semmeling et al. | 439/353 |
| 6,346,002 | B1 * | 2/2002 | Hsu et al. | 439/358 |
| 2005/0282424 | A1 * | 12/2005 | Huang et al. | 439/353 |

* cited by examiner

*Primary Examiner*—Truc Nguyen

(57) ABSTRACT

In a security apparatus for securing an electrical connector, a plug may be fitted for insertion into a connector receptacle compliant with a connector standard. The plug has at least one aperture adapted to engage at least one latch in the connector receptacle. An engagement member is adapted to partially extend through at least one aperture and lock to at least one structure within the connector receptacle.

13 Claims, 13 Drawing Sheets

DATA PORT SECURITY LOCK

BACKGROUND

This invention was developed under Contract DE-AC04-94AL85000 between Sandia Corporation and the U.S. Department of Energy. The U.S. Government has certain rights in this invention.

BACKGROUND

Owners and users of computers and other electronic devices are highly sensitive to data security concerns. Many corporations and government agencies limit access to data. One technique for restricting data access is to limit devices to which a user can connect or disconnect their computers, thereby preventing employees from copying information from computer systems onto storage media or storage devices that the employee might remove from the premises. Limiting device access can also prevent employees from uploading harmful, unlicensed, or otherwise improper software, data, or viruses onto company computers.

Companies use various techniques to prevent uploading and downloading of information. Some prohibit all removable media devices from the computers, for example including floppy drives, compact disk (CD) writers, Iomega ZIP drives and Jaz drives, and others. Another solution is to place a mechanical locking device in place of the standard media. Other techniques include attaching or gluing a lock which prevents a drive such as a floppy drive, a compact disk (CD) drive, a digital versatile disk (DVD) drive, or other drive from opening. Further security methods may include the usage of terminals without any local storage capability.

The above-described solutions do not fully ensure data security because various interfaces may remain that allow access to data, including serial ports, parallel ports, or other types of data interfaces such as Universal Serial Bus (USB) ports on any computer surfaces to which an employee can still connect an external storage device. Some companies have taken steps to prevent data access by physically removing the data ports, breaking pins inside the ports, or by sealing the ports with epoxy, resulting in an irreversible and permanent disabling of the ports. If a computer support technician desires to later update system software on the computer, the disabled ports prevent reconnection of devices that would allow updating or restoration of the system software.

Even actions such as opening the computer case, removing an internal hard drive, and replacing the drive on an unprotected computer with the capability to upload software may not be feasible due to differences in hardware and an inability to install software patches on the computer within which the hard drive is ultimately to execute.

SUMMARY

According to an embodiment of a security apparatus for securing an electrical connector, a plug may be fitted for insertion into a connector receptacle compliant with a connector standard. The plug has at least one aperture adapted to engage at least one latch in the connector receptacle. An engagement member is adapted to partially extend through at least one aperture and lock to at least one structure within the connector receptacle.

BRIEF DESCRIPTION OF THE DRAWINGS

Embodiments of the invention relating to both structure and method of operation may best be understood by referring to the following description and accompanying drawings.

DETAILED DESCRIPTION

What is desired is an apparatus, system, and/or associated method which enables an authorized technician to access the ports while maintaining the ports inaccessible to unauthorized persons and usage.

One example of an existing data interface is a Universal Serial Bus (USB) interface. USB is a standardized technology enabling connection of various devices for communication with computers. Various USB devices include keyboards, mice, external hard drives, Motion Picture Experts Group (MPEG)-1 Layer III (MP3) players, storage devices, and a variety of other devices. USB is similar to serial and parallel port technology although with smaller connectors and ports. USB enables a higher speed communication channel than some other communication interfaces. A USB port can connect more than one device via usage of a USB hub, a device for converting a single port to multiple ports.

Although data ports are commonly positioned on the back of a computer chassis, some manufacturers position ports on other surfaces, such as the front panel, to facilitate connection and disconnection. The small size, flexibility, and popularity of the USB interface make the interface highly suited for front-panel usage.

A security lock is disclosed that enables locking of a data port. The disclosure presents two categories of security lock. A first type of lock is configured to lock a data port to prevent any access. A second type of lock enables connection of a cable to an authorized device while preventing any unauthorized connection.

The second type lock is particularly useful in the context of devices such as Universal Serial Bus (USB) keyboards and mice. A lock that prevents any access to a data port may render useless a computer system which depends on the USB interface for keyboard and mouse access. However, if such a port is left without security, the mouse or keyboard could be disconnected and the port attached to a hub or other device, enabling unauthorized data access.

A security lock is disclosed that enables authorized devices to connect to a port while preventing a user from disconnecting from the port and connecting to a hub. For a system with no essential devices, such as keyboards, mice, or the like, a simple locking plug can be inserted into a port, effectively locking the port from access. For a system which includes an essential device, a locking plug attached to a cable can be attached to the port and locked, limiting port access to an authorized device coupled to the cable.

Figure 1A:
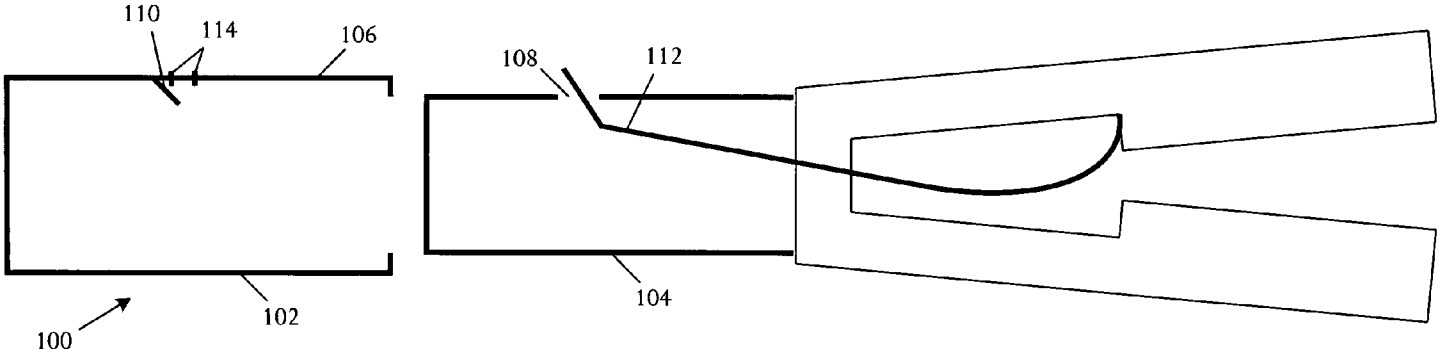
FIGS. 1A and 1B are schematic pictorial diagrams illustrating an embodiment of a security apparatus adapted for connection to a port of a computer or other information handling device to prevent connection of a data cable and unauthorized access to data.
Figure 1B:
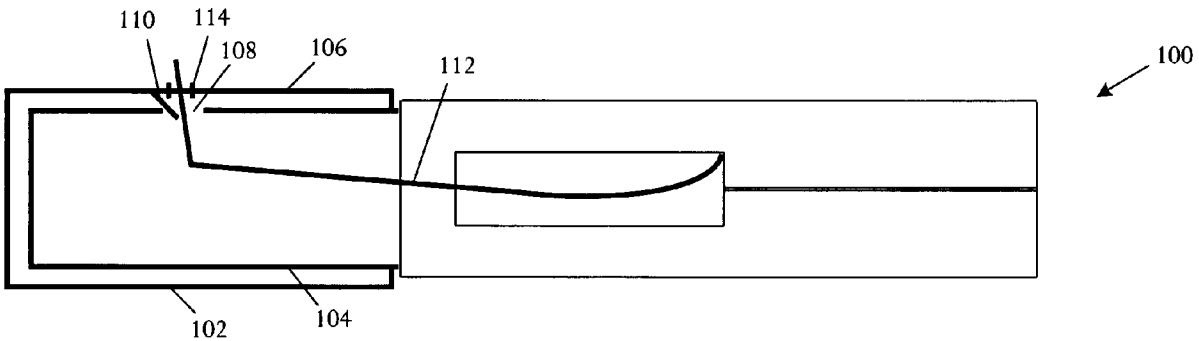

Referring to FIGS. 1A and 1B, schematic pictorial diagrams illustrate an embodiment of a security apparatus 100 that is adapted for securing an electrical connector 102. The security apparatus 100 connects to a port of a computer or other information handling device to prevent connection of a data cable for the purpose of unauthorized access to data. The security apparatus 100 comprises a plug 104 fitted for insertion into a connector receptacle 106 that is compliant with a connector standard. The plug 104 has one or more apertures 108 in a configuration that enables engagement with one or more latches 110 in the connector receptacle 106. The security apparatus 100 further comprises an engagement member 112 coupled to the plug 104 that is adapted to partially extend through the apertures 108 on the plug 104 and the apertures 114 on the connector receptacle 106. FIG. 1A shows the security apparatus 100 with the plug 104 detached from the connector receptacle 106. FIG. 1B shows the security apparatus with the plug 104 inserted into the connector receptacle, also called a port 106.

The security apparatus 100 may be configured to secure an electrical connector by fitting a plug 104 for insertion into a connector receptacle 106 which is compliant with a connector standard. One or more apertures 108 are formed in the plug 104 in an arrangement that enables engagement of the apertures 108 with a latch 110 in the connector receptacle 106. The port is secured by adapting an engagement member 112 to enable coupling to the plug 104 and partially extending through the apertures 108 and the apertures 114 on the connector receptacle 106.

In various embodiments, different types of engagement members 112 may be used. Some embodiments may employ a metal spring, such as spring steel constructed from a strong material that resists bending or deformation. Spring steel may be blue tempered and hardened, for example with carbon content in a range of 0.8% to 1.1%, although any suitable carbon content may be used. Spring steel may be a sheet sufficiently thin to fit between a contact plate and a plug housing and resists release under strain of a forced removal of the plug. The end of the spring distal from the engagement features is typically either fixed to the housing or wedged into the housing, although other arrangements may be used. The length of the steel sheet and size of the housing may be any suitable to extend engagement features through holes in the plug.

Other embodiments may implement a section of elastic or plastic material, such as a rubber or rubber-like material, which can be pushed into the plug area and expanded to create a friction lock. In another example, a wire can be shaped to move into holes on the plug. Also, a lever-type wire can be formed to enter and exit holes formed on lateral surface of the plug, creating flanges adapted to grip the port.

Figure 2A:
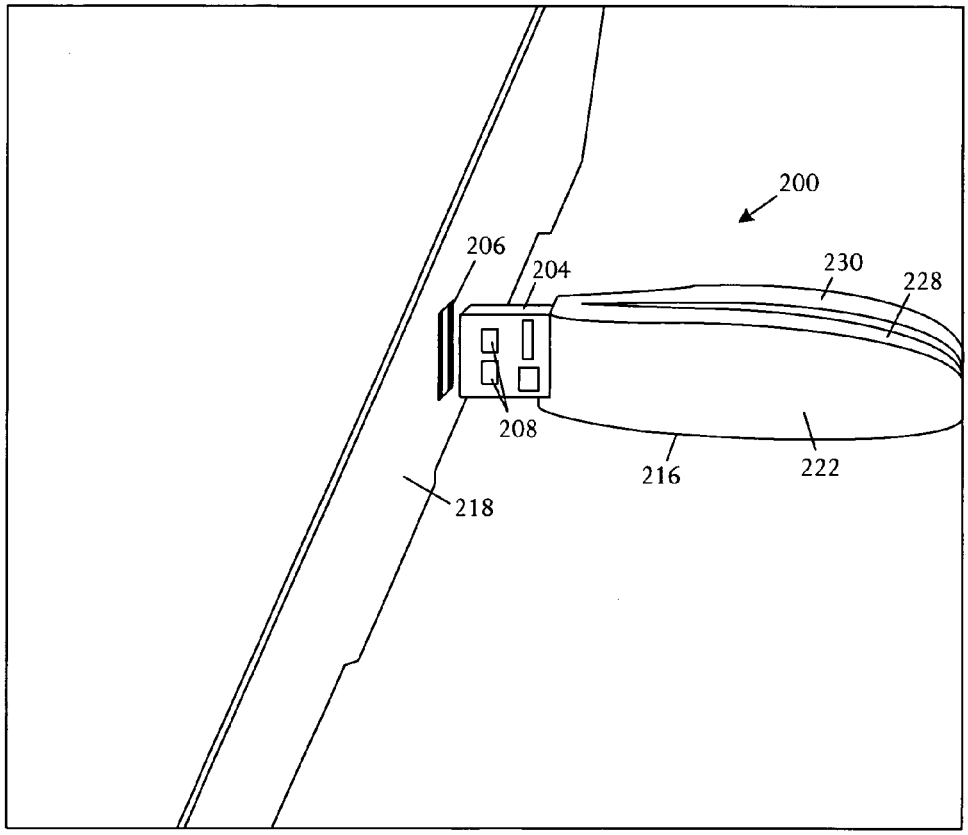
FIGS. 2A, 2B, 2C, 2D, and 2E are pictorial diagrams depicting usage and structure of an embodiment of a security lock.
Figure 2B:
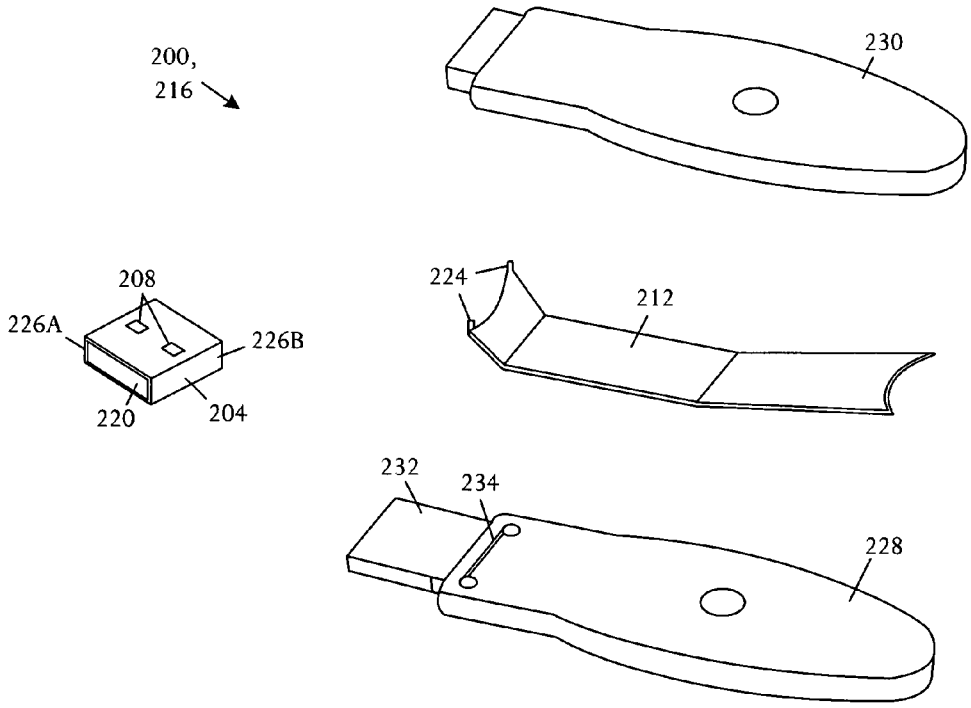
Figure 2C:
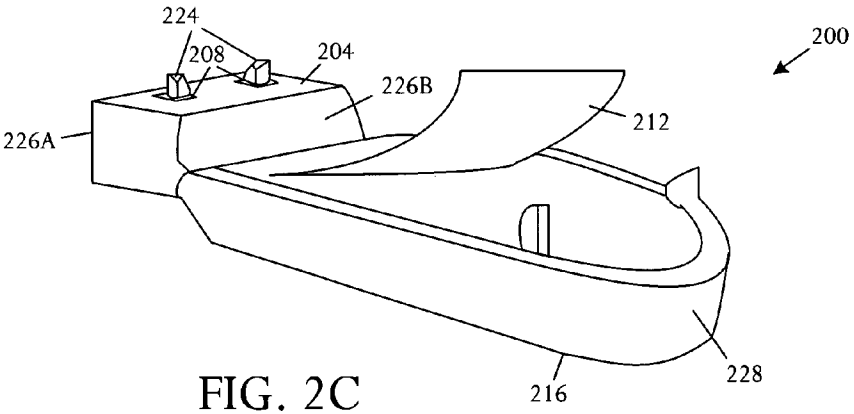
Figure 2E:
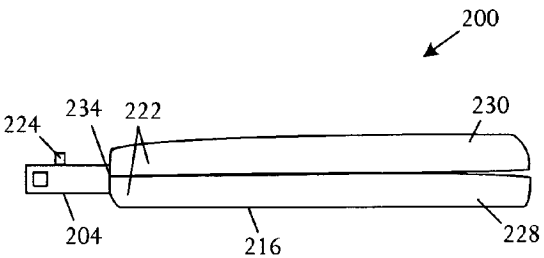
Figure 2D:
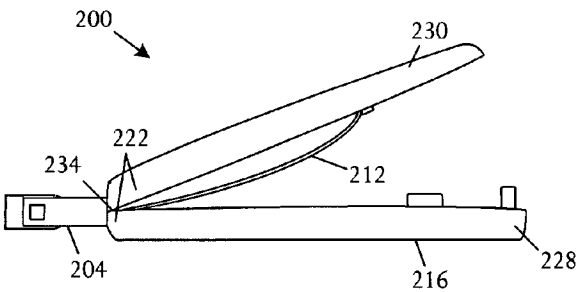

Referring to FIGS. 2A, 2B, 2C, 2D, and 2E, several pictorial diagrams illustrate an embodiment of the security apparatus 200. FIG. 2A illustrates a pictorial view of a security lock 216 in position for insertion into a port or connector receptacle 206 of a laptop computer 218. FIG. 2B illustrates a pictorial exploded view of the security lock 206. FIG. 2C illustrates a perspective pictorial view of the security lock 216 with locking engagement structures shown extended into locking position. FIG. 2D shows a side pictorial view of the security lock 216 in an open condition, ready for insertion into a port 216. FIG. 2E depicts a side pictorial view of the security lock 216 closed into a configuration that locks a port 206 when inserted.

The security lock 216 comprises a shell 204 disposed about an interior cavity 220 which is fitted for insertion into the connector receptacle 206. The shell 204 has one or more apertures 208 in a position and configuration adapted to engage latches in the connector receptacle 206. The security lock 216 further comprises an articulating housing 222 formed in a configuration for coupling to the shell 204. The security lock 216 further comprises a spring 212 formed with one or more protuberances 224 and in an arrangement for engagement by the articulating housing 222 when the housing 222 is closed so that the protuberances 224 are extended through the apertures 208 to engage a structure in the connector receptacle 206.

The exploded view in FIG. 2B separately shows constituent parts of the security lock embodiment. The shell 204 may be formed as a hollow rectangular cube, for example with two opposing ends omitted to enable a connection interface with the connector receptacle 206 on one end 226A and a structure for coupling with the housing 222 on the opposing end 226B. The illustrative housing 222 includes a first member 228 and a second member 230. The first member 228 is formed of a substrate 232 which is fitted to insert into the shell 204. The first member 228 has a hinge 234 adapted to connect to the second member 230 so that the first and second members form an articulating housing structure. The first and second members include structures, for example ridges, shafts, notches, pips, nubs, and the like in configurations adapted to hold the spring 212.

In another embodiment of a technique for configuring a security lock 216, a shell 204 can be constructed in a configuration arranged about an interior cavity 220 and fitted for insertion into a connector receptacle 206. One or more apertures 208 may be formed in an arrangement that engages one or more latches in the connector receptacle 206. An articulating housing 222 may be attached to the shell 204. A spring 212 is configured with one or more protuberances. The spring 212 and housing 222 are constructed so that the spring 212 is held within the housing on housing closure so that one or more of the protuberances extends through apertures to engage a structure in the connector receptacle 206.

Figure 3:
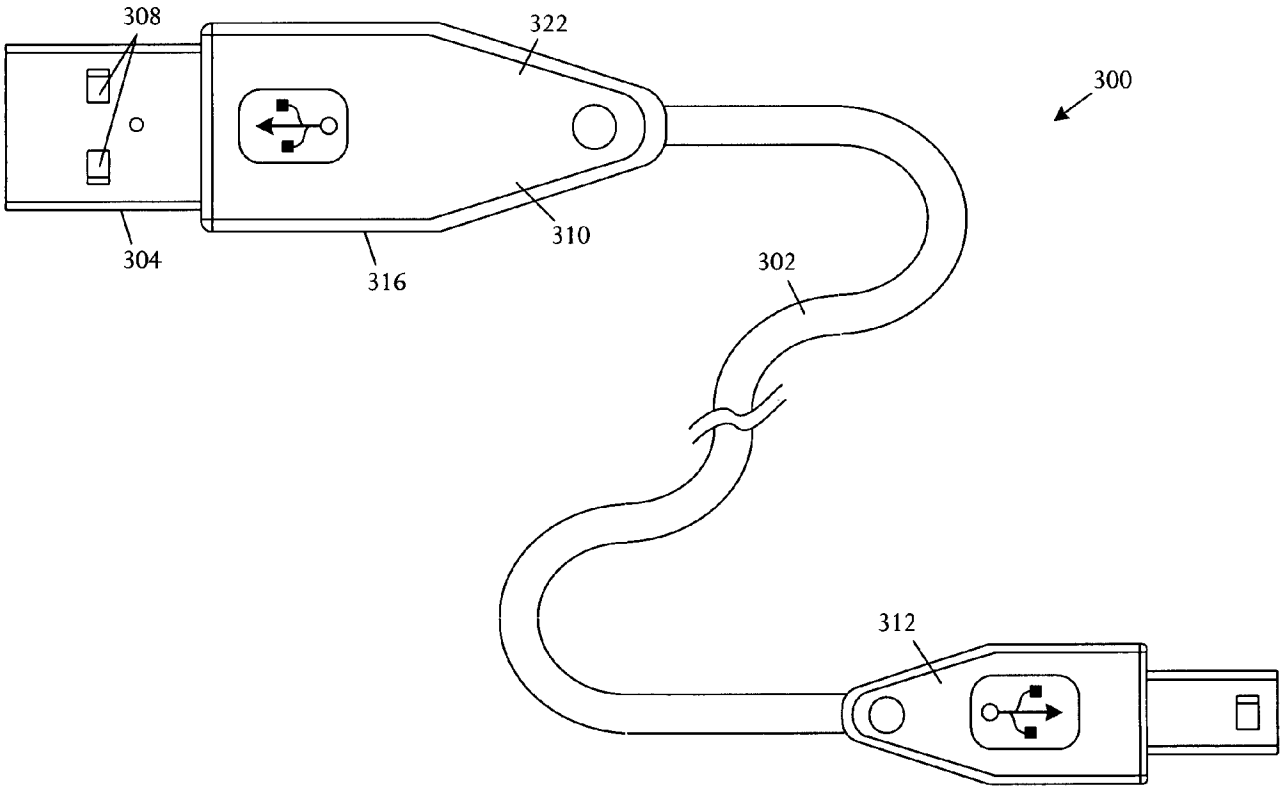
FIG. 3 is a pictorial view showing an embodiment of a security apparatus that enables usage of a port for desirable or necessary access while maintaining security.

The security apparatus 100 shown in FIGS. 1A and 1B and the security lock 216 depicted in FIGS. 2A, 2B, 2C, 2D, and 2E can be used to enable authorized access to data by connection of authorized devices under control of authorized users to access to a data port of a secure system. The apparatus 100 and lock 216 prevent a user from disconnecting from the port and inserting a cable for connection to an unauthorized device, such as a hub. Accordingly, the apparatus 100 and lock 216 can be placed in any appropriate port, effectively preventing the port from being accessed by a user. However, in come circumstances, conditions and applications, access to the data port may be desirable or necessary. For example, some computer systems use a Universal Serial Bus (USB) interface for peripherals that may be required for operation such as a keyboard or mouse. Referring to FIG. 3, a pictorial view illustrates an embodiment of a security apparatus 300 that enables usage of a port for such desirable or necessary access while maintaining security. In addition to security structures such as shown in FIGS. 1A, 1B, or FIGS. 2A, 2B, 2C, 2D, and 2E, the security apparatus 300 further comprises a cable 302 coupled to a plug 304 which is configured to carry electrical signals between a first device coupled to a connector receptacle and a second device.

In some embodiments, the security apparatus 300 may be used with a Universal Serial Bus (USB) device which is required for computer system operation, such as a keyboard and/or mouse, and may include a USB lock 316 with an active USB type-cable 302 connected between a USB port of a computer and a USB device, forming an active USB cable 302 adapted to lock at both ends for security.

The USB topology is formed by connecting a downstream hub port to the upstream port of another hub or device. Current USB technology operates at three speeds. High-speed (480 Megabytes/second (Mb/s)) and full-speed (12 Mb/s) use a shielded cable with two power conductors and twisted pair conductors. Low-speed (1.5 Mb/s) may use, but does not require, a cable with twisted-pair signal conductors. The connectors are designed to be hot-plugged.

The illustrative security apparatus 300 has a Universal Serial Bus (USB) shell 304 that functions as a plug and is disposed about an interior cavity fitted for insertion into a USB connector receptacle which is compliant with a Universal Serial Bus standard. The USB shell 304 has two apertures 308 in an arrangement that engages latches in the USB connector receptacle. The security apparatus 300 also comprises an articulating housing 322 adapted to couple to the USB shell 304. A spring steel sheet internal to the housing 322 has two protuberances or pips having a structure configured for engagement by the articulating housing 322 when the housing 322 is closed so that the protuberances or pips are extended through the apertures 308 to engage structures in the USB connector receptacle. The spring steel sheet and pips are typically made sufficiently rigid to remain engaged with the USB connector receptacle structures during forced removal of the plug 304 from the USB connector receptacle.

In the illustrative embodiment, the cable 302 may be a four-strand USB cable with a first locking connector 310 compliant with specifications for the Universal Serial Bus (USB) standard defining a Series "A" connector, and a second locking connector 312 compliant with the USB standard defining a Series "B" connector. To reduce end-user termination problems, the USB Standard defines a "keyed connector" protocol with the physical differences in size and shape of Series "A" and "B" connectors to assure proper end-user connectivity. The "A" connector is used to connect USB devices directly to a Host or to the downstream port of a Hub. Typically all USB devices use a standard Series "A" connector. The Series "B" connector enables device vendors to supply a detachable cable, facilitating end-user cable replacement. The USB standard specifies that Series "A" plugs are oriented upstream towards a Host System and insert into a Series "A" receptacle configured for downstream output from a USB Host or Hub. The USB Series "B" plugs are oriented downstream towards a USB Device for insertion into a Series ""B" receptacle configured for upstream input to the USB Device or Hub.

The "B" connector, also called a downstream connector, is also secured or locked. According to the USB standard, the B connector 312 does not include apertures or holes in the plug, presenting increased difficulty in comparison to the A connector 310. In some embodiments, apertures or holes may be formed in the B connector contrary to the standard. In other embodiments, a standard B connector may be used and the B connector plug epoxied to the downstream device to ensure security. In additional embodiments, any suitable technique or structure may be used to secure the B connector to the downstream device.

Referring to FIG. 4A, 4B, 4C, 4D, and 4E, multiple pictorial diagrams illustrate various embodiments of locking structures 402 which can be used to fasten a security lock 400. The security lock 400 comprises a shell 404 disposed about an interior cavity fitted for insertion into a connector receptacle. The shell 404 has one or more apertures 408 configured to engage a structure in the connector receptacle. An articulating housing 416 is configured to couple to the shell 404 and manipulate an engagement member to partially extend through the apertures 408 and engage the connector receptacle structure or structures. The locking structures 402 are configured to lock the articulating housing 416 in an arrangement that locks the shell 404 in insertion into the connector receptacle.

In the illustrative examples, the housing 416 comprises articulating members that can be positioned in a closed position and open position by relatively pivoting the members about an edge. The members may have aligned holes 414 configured to accept a locking structure 402.

Figure 4A:
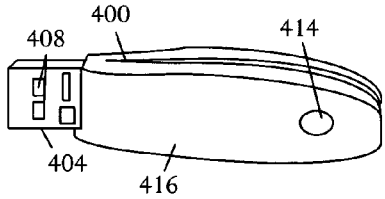
FIG. 4A, 4B, 4C, 4D, and 4E are pictorial diagrams illustrating various embodiments of locking structures which can be used to fasten a security lock.
Figure 4D:
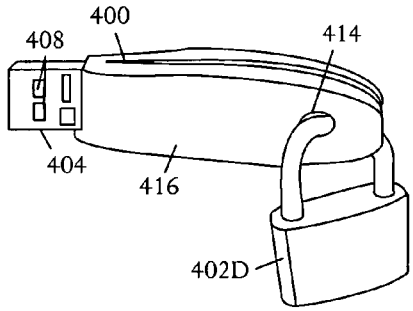
Figure 4B:
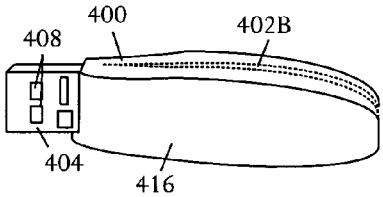

FIG. 4B shows a locking structure 402 in the form of epoxy 402B that can be used to fasten the security lock 400 in the closed position.

Figure 4E:
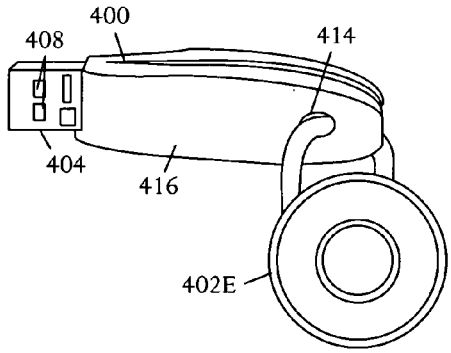
Figure 4C:
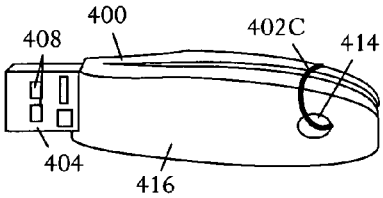

In another example, a seal 402C may be threaded through holes 414 in the articulating housing 416 to form a locking structure depicted in FIG. 4C. The seal 402C may be formed from any suitable material, such as a high-strength cable or wire.

FIG. 4D illustrates a keyed lock 402D with a bar which is inserted through the holes and locked into place. A key lock 402D, such as a mechanical lock, balanced magnetic switch, and the like, may be attached to the security lock 400 to form a device that is easily removed by an authorized user who possesses the associated key. Similarly, FIG. 4E shows a combination lock 402E.

Figure 5:
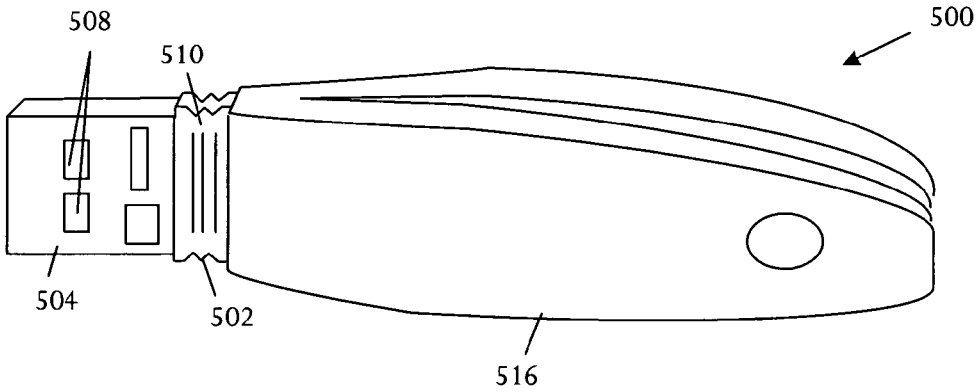
FIG. 5 is a pictorial diagram showing an embodiment of a security lock adapted for tamper-resistance.

Referring to FIG. 5, a pictorial diagram illustrates an embodiment of a security lock 500 adapted for tamper-resistance. The security lock 500 with anti-tamper functionality may include a stress joint 510 between the plug 504 and housing 516 so that pulling on the housing 516 without proper unlocking of the plug 504 causes the plug 504 to break from the housing 516 and remain inside the port. The engagement device, such as a spring, may similarly include a stress-joint to seal the lock 500 against attempts to remove remaining pieces and rendering the port again usable.

In the illustrative embodiment, a shell 504 is disposed about an interior cavity which is fitted for insertion into the connector receptacle. Again, the shell 504 has an aperture or apertures 508 adapted to engage latches in the connector receptacle. An articulating housing 516 couples to the shell 504 and manipulates the engagement member to partially extend through the apertures 508 and engage a structure in the connector receptacle. The illustrative security lock 500 adds an anti-tamper structure 502 that may be coupled between the shell 504 and the articulating housing 516. The anti-tamper structure 502 forms a stress joint 510 that breaks the shell 504 from the articulating housing 516 in response to attempts to remove the plug in absence of proper unlocking.

Figure 6:
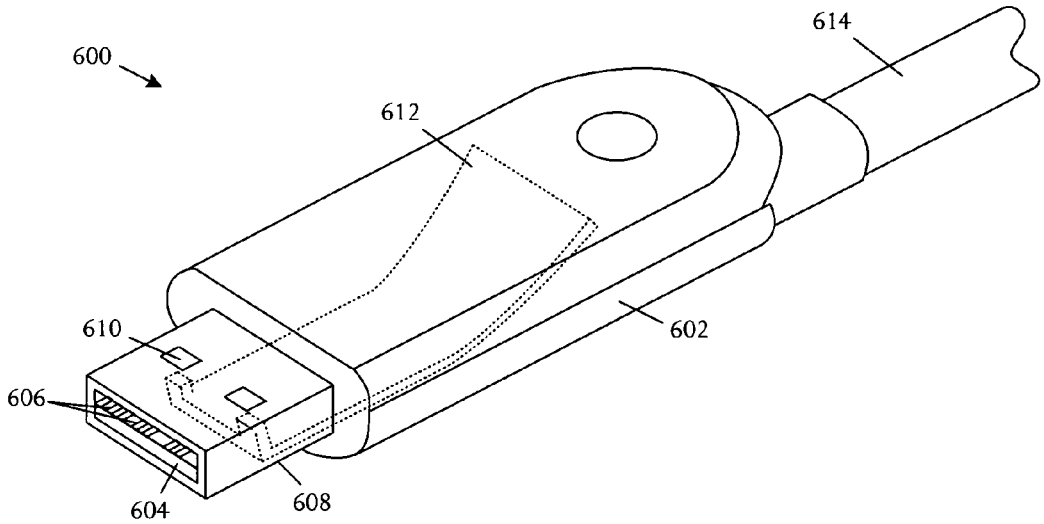
FIG. 6 is a perspective pictorial diagram illustrating an embodiment of a Universal Serial Bus (USB) apparatus adapted for data security.

Referring to FIG. 6, a perspective pictorial diagram illustrates an embodiment of a Universal Serial Bus (USB) apparatus 600 comprising a Universal Serial Bus (USB) electrical connector 602. The USB connector 602 is typically used to connect a USB-enabled device to an electronic device such as a computer or host. The illustrative USB connector 602 comprises a signal contact-supporting substrate 604, multiple electrical signal conductor traces and electrical power conductor traces 606 formed on the signal contact-supporting substrate 604. A plug 608 is configured to enclose the signal contact-supporting substrate 604 and fitted for insertion into a Universal Serial Bus (USB) connector receptacle. The plug 608 has apertures 610 configured to engage latches in the USB connector receptacle. An engagement member 612 is coupled to the plug 608 and is adapted to partially extend through the apertures 610 and lock to a structure within the USB connector receptacle.

In some embodiments, the USB apparatus 600 may further include a Universal Serial Bus (USB) cable 614 coupled to the USB connector 602 and configured to carry electrical signals between a first Universal Serial Bus (USB)-adapted device, for example a computer, which is coupled to the USB connector receptacle and a second USB-adapted device.

Figure 7A:
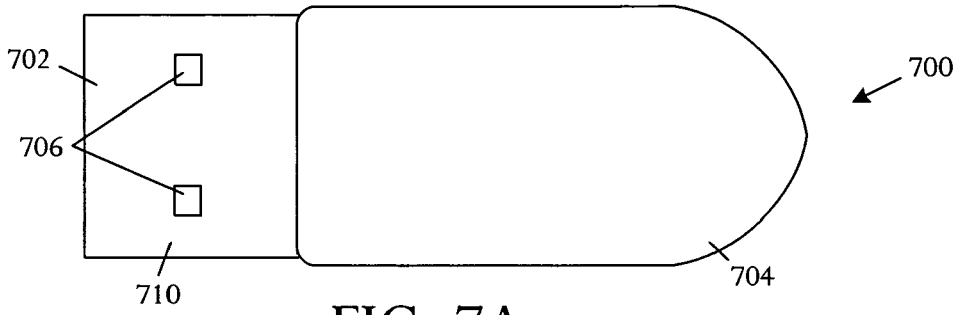
FIGS. 7A, 7B, 7C, 7D, 7E, 7F, and 7G are pictorial views showing parts of an embodiment of a security lock.
Figure 7B:
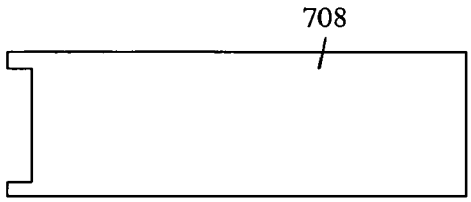
Figure 7C:
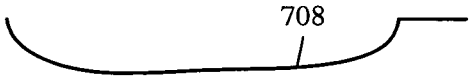
Figure 7D:
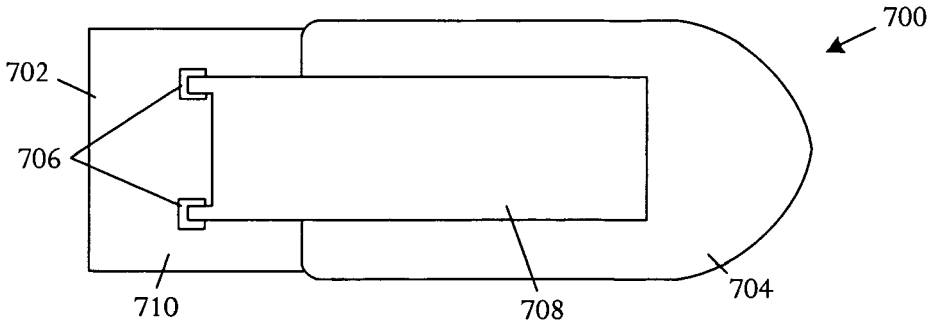
Figure 7E:
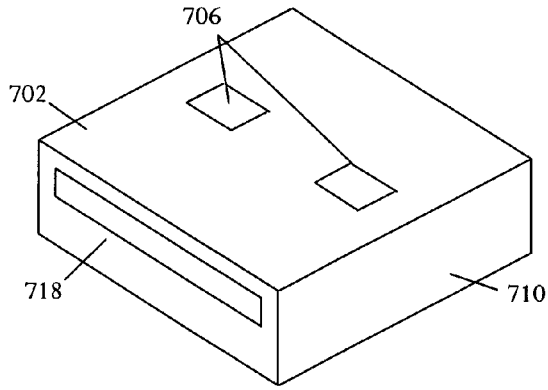
Figure 7F:
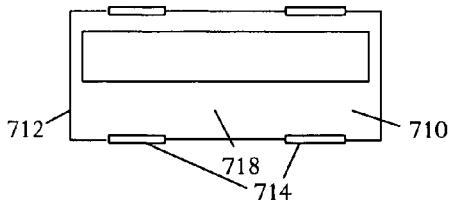
Figure 7G:
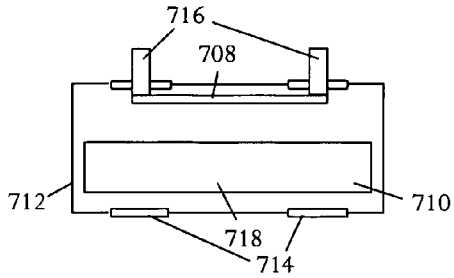

Referring to FIGS. 7A, 7B, 7C, and 7D, several pictorial views of parts of an embodiment of a security lock 700 are shown. FIG. 7A is a plan view showing a Universal Serial Bus (USB) shell 702 and a member 704 of two associated articulating members that, in combination, form a housing. Two apertures 706 are formed in the USB shell 702. The member 702 is typically constructed from a substrate, such as plastic, materials typically used to construct printed circuit boards, or other materials. FIG. 7B is a plan view showing a spring 708 which is used as an engagement member for firmly and non-removably engaging the security lock 700 with a port or connector receptacle. FIG. 7C is a side view depicting the spring 708. FIG. 7D is a plan view depicting the spring 708 positioned inside the housing in position adjacent the member 702. FIG. 7E illustrates a perspective pictorial view of a USB plug 710 including the USB shell 702. FIG. 7F illustrates an end view of a port 712 into which the plug 710 is inserted. The port 712 has multiple USB contact plates 714. FIG. 7G shows an end view of the port 712 with the plug 710 inserted and protuberances or pips 716 of the spring 708 extended and engaging the port 712.

The Universal Serial Bus (USB) shell 702 is disposed about an interior cavity 718 which has a configuration enabling the shell 702 to enclose at least a portion of a signal contact-supporting substrate. The USB shell 702 is fitted for insertion into a USB connector receptacle or port 712. Two apertures 706 in the USB shell are arranged to engage latches in the USB connector receptacle 712. The articulating housing is configured to couple to the USB shell 702. The spring 708 is formed for engagement by the articulating housing so that the protuberances or pips 716 extend through the apertures 706 to engage one or more structures within the USB connector receptacle 712.

In an illustrative embodiment, the spring 708 is constructed from a spring steel sheet and the protuberances or pips 716 are sufficiently rigid to remain engaged with the USB connector receptacle structures under conditions when forced removal of the USB plug 710 from the USB connector receptacle 712 is attempted.

Figure 8A:
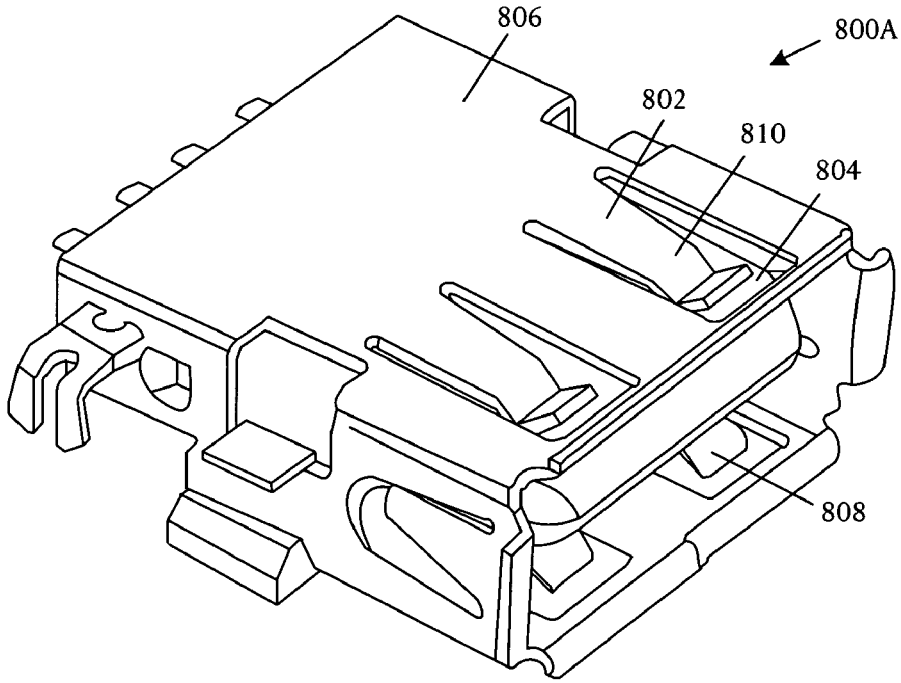
FIGS. 8A and 8B are perspective pictorial views illustrating embodiments of USB connector receptacles, for example including a single-port receptacle and a dual-port receptacle, respectively.
Figure 8B:
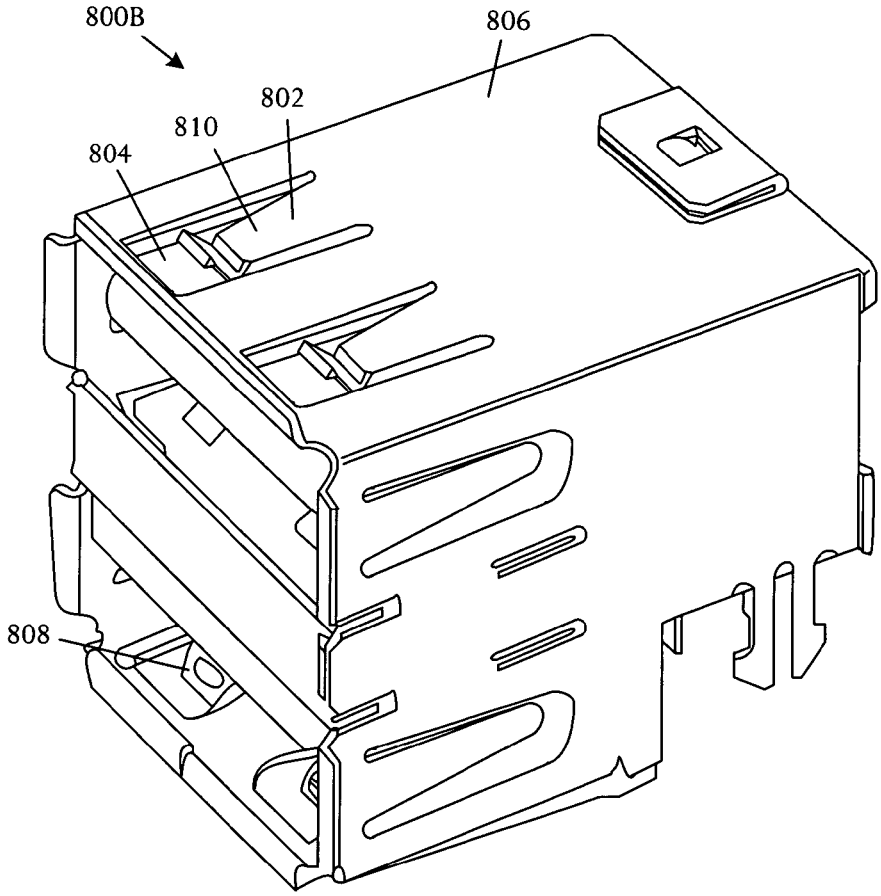

FIGS. 8A and 8B illustrate embodiments of USB connector receptacles, for example including a single-port receptacle 800A and a dual-port receptacle 800B, respectively. Various structures in the receptacles may be engaged by various engagement structures in different plug embodiments. For example, in the illustrative receptacle embodiments 800A and 800B, structures that may be engaged by plug engagement elements include latches 802, apertures or holes 804 cut into receptacle sidewalls 806, engaging heads 808, contact tabs 810, and the like. Other structures to which may be engaged include the receptacle housing, the receptacle shell, receptacle contacts, contact points, receptacle flanges and others.

Figure 9:
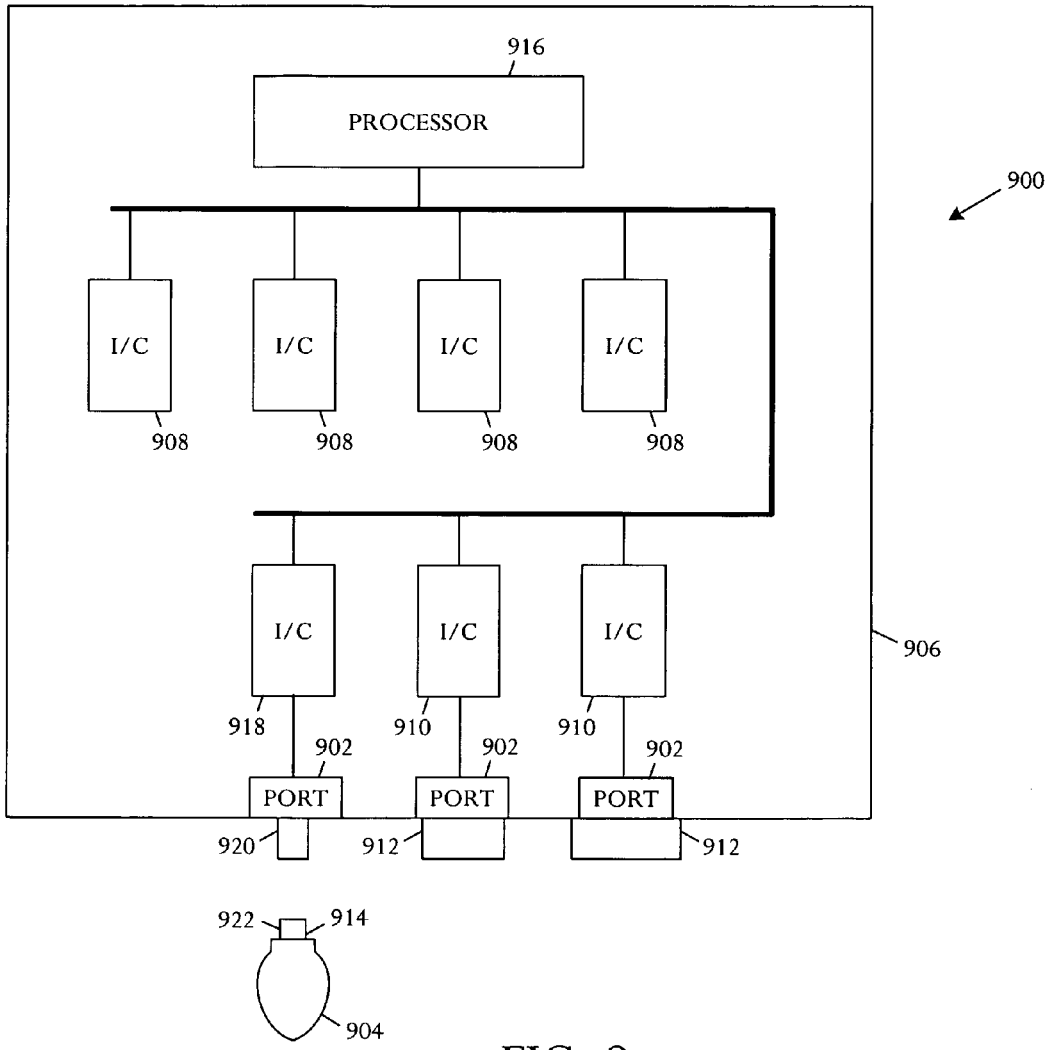
FIG. 9 is a schematic block diagram showing an embodiment of an electronic system, for example a computer, with one or more data ports protected using the illustrative security apparatus.

Referring to FIG. 9, a schematic block diagram illustrates an embodiment of an electronic system 900, for example a computer, with one or more data ports 902 protected using the illustrative security apparatus 904. The electronic system 900 comprises a housing 906, one or more electronic components 908 such as integrated circuits contained within the housing 906, and a data interface 910 coupled to the electronic components 908. The electronic system 900 also has one or more connector receptacles 912 adapted to receive respective electrical connectors 914. Electrical connectors 914 implementing security features such as the features depicted herein enable data stored in the electric system 900 to be secured.

In an illustrative embodiment, the electronic system 900 may be a computer and the electronic components 908 may include one or more processors 916. For example a Universal Serial Bus (USB) interface 918 may be connected to the electronic components 908. Universal Serial Bus (USB) connector receptacles 920 may be included that are configured to receive respective USB electrical connector 922. The USB electrical connector 922 may implement the disclosed security features. The security apparatus 904 may lock into place to secure a data port 902 using an appropriate locking structure selected from among various types including an epoxy that holds the articulating housing in a closed position, a key lock that holds the articulating housing in the closed position, a combination lock that holds the articulating housing in the closed position, a balanced magnetic switch that holds the articulating housing in the closed position, a proximity lock, and others.

The security apparatus 904 may also implement anti-tampering structures, such as a stress-joint configured to prevent unauthorized access to the port.

The security apparatus 904 may be used to protect data in the electronic system 900. An electrical connector or plug 914 is inserted into a connector receptacle 912 whereby the plug 914 and receptacle 912 are compliant with a particular standard. For example, a Universal Serial Bus (USB) plug 922 may be inserted into a USB receptacle 920. The port 902 is secured by deploying an engagement member coupled to the plug that partially extends through the plug 914 and engaging the engagement member with a structure in the connector receptacle 912. The engagement member may be locked to the connector receptacle 912 using various permanent or temporary locking structures.

While the present disclosure describes various embodiments, these embodiments are to be understood as illustrative and do not limit the claim scope. Many variations, modifications, additions and improvements of the described embodiments are possible. For example, those having ordinary skill in the art will readily implement the steps necessary to provide the structures and methods disclosed herein, and will understand that the process parameters, materials, and dimensions are given by way of example only. The parameters, materials, and dimensions can be varied to achieve the desired structure as well as modifications, which are within the scope of the claims. Variations and modifications of the embodiments disclosed herein may also be made while remaining within the scope of the following claims. For example, although the illustrative embodiments depict USB components and devices, other existing and/or future connector types, such as serial connectors, parallel connectors, and others, may be similarly configured to supply data security. Similarly, although the embodiments depict data connectors for computers, the illustrative security structures and techniques may be applied to other types of electronic systems including communication systems, storage systems, consumer electronics, automotive electronics and others.

What is claimed is:

1. A security apparatus adapted for securing an electrical connector comprising:

a plug fitted for insertion into a connector receptacle compliant with a connector standard, the plug having at least one aperture adapted to engage at least one latch in the connector receptacle;

an engagement member coupled to the plug and adapted to partially extend through the at least one aperture and lock to at least one structure within the connector receptacle;

a shell disposed about an interior cavity fitted for insertion into the connector receptacle and having at least one aperture adapted to engage at least one latch in the connector receptacle;

an articulating housing adapted to couple to the shell; and a spring configured with at least one protuberance and adapted for engagement by the articulating housing upon housing closure whereby the at least one protuberance is extended through the at least one aperture to engage the at least one structure in the connector receptacle.

2. A security apparatus adapted for securing an electrical connector comprising:

a plug fitted for insertion into a connector receptacle compliant with a connector standard, the plug having at least one aperture adapted to engage at least one latch in the connector receptacle;

an engagement member coupled to the plug and adapted to partially extend through the at least one aperture and lock to at least one structure within the connector receptacle;

a shell disposed about an interior cavity fitted for insertion into the connector receptacle and having at least one aperture adapted to engage at least one structure in the connector receptacle;

an articulating housing adapted to couple to the shell and manipulate the engagement member to partially extend through the at least one aperture and engage the at least one structure in the connector receptacle; and a locking structure adapted to lock the articulating housing in a configuration that locks the shell in insertion into the connector receptacle.

3. The apparatus according to claim 2 wherein:

the locking structure is a structure selected from among a group consisting of a seal that passes through at least one aperture in the shell and through an aperture in the connector receptacle, an epoxy that holds the articulating housing in a closed position, a key lock that holds the articulating housing in the closed position, a combination lock that holds the articulating housing in the closed position, a balanced magnetic switch that holds the articulating housing in the closed position, and a proximity lock.

4. A security apparatus adapted for securing an electrical connector comprising:

a plug fitted for insertion into a connector receptacle compliant with a connector standard, the plug having at least one aperture adapted to engage at least one latch in the connector receptacle;

an engagement member coupled to the plug and adapted to partially extend through the at least one aperture and lock to at least one structure within the connector receptacle;

a shell disposed about an interior cavity fitted for insertion into the connector receptacle and having at least one aperture adapted to engage at least one latch in the connector receptacle;

an articulating housing adapted to couple to the shell and manipulate the engagement member to partially extend through the at least one aperture and engage at least one structure in the connector receptacle; and an anti-tamper structure coupled between the shell and the articulating housing and adapted to form a stress joint that breaks the shell from the articulating housing in response to attempts to remove the plug in absence of proper unlocking.

5. The apparatus according to claim 4 further comprising:

an electronic system comprising:

a housing;

at least one electronic component contained within the housing;

a data interface coupled to the at least one electronic component; and at least one connector receptacle adapted to receive respective at least one electrical connector.

6. A Universal Serial Bus (USB) apparatus comprising:

a Universal Serial Bus (USB) electrical connector comprising:

a signal contact-supporting substrate;

a plurality of electrical signal conductor traces and electrical power conductor traces formed on the signal contact-supporting substrate;

a plug configured to enclose the signal contact-supporting substrate and fitted for insertion into a Universal Serial Bus (USB) connector receptacle, the plug having apertures adapted to engage latches in the USB connector receptacle; and an engagement member coupled to the plug and adapted to partially extend through the apertures and lock to a structure within the USB connector receptacle.

7. The apparatus according to claim 6 further comprising:

a shell disposed about an interior cavity configured to enclose at least a portion of the signal contact-supporting substrate and fitted for insertion into the USB connector receptacle, the shell having apertures adapted to engage latches in the USB connector receptacle;

an articulating housing adapted to couple to the shell; and a spring configured with at least one protuberance and adapted for engagement by the articulating housing upon housing closure whereby the at least one protuberance is extended through the apertures to engage to the structure in the USB connector receptacle.

8. The apparatus according to claim 6 further comprising:

a Universal Serial Bus (USE) shell disposed about an interior cavity configured to enclose at least a portion of the signal contact-supporting substrate and fitted for insertion into the USB connector receptacle, the USB shell having two apertures adapted to engage latches in the USB connector receptacle;

an articulating housing adapted to couple to the USB shell; and a spring steel sheet configured with two pips and adapted for engagement by the articulating housing upon housing closure whereby the pips are extended through the apertures to engage structures in the USB connector receptacle, the spring steel sheet and pips being sufficiently rigid to remain engaged with the USB connector receptacle structures during forced removal of the plug from the USB connector receptacle.

9. The apparatus according to claim 6 further comprising:

a Universal Serial Bus (USB) cable coupled to the plug and configured to carry electrical signals between a first Universal Serial Bus (USB)-adapted device coupled to the USB connector receptacle and a second USB-adapted device.

10. The apparatus according to claim 6 further comprising:

a Universal Serial Bus (USB) shell disposed about an interior cavity configured to enclose at least a portion of the signal contact-supporting substrate and fitted for Insertion into the USB connector receptacle, the USB shell having apertures adapted to engage latches in the USB connector receptacle;

an articulating housing adapted to couple to the USB shell and manipulate the engagement member to partially extend through the apertures and engage structures in the connector receptacle; and a locking structure adapted to lock the articulating housing in a configuration that locks the shell in insertion into the USB connector receptacle.

11. The apparatus according to claim 10 wherein:

the locking structure is a structure selected from among a group consisting of a seal that passes through at least one aperture in the shell and through an aperture in the connector receptacle, an epoxy that holds the articulating housing in a closed position, a key lock that holds the articulating housing in the closed position, a combination lock that holds the articulating housing in the closed position, a balanced magnetic switch that holds the articulating housing in the closed position, and a proximity lock.

12. The apparatus according to claim 6 further comprising:

a Universal Serial Bus (USB) shell disposed about an interior cavity fitted for insertion into the USB connector receptacle and having apertures adapted to engage latches in the USB connector receptacle;

an articulating housing adapted to couple to the USB shell and manipulate the engagement member to partially extend through the apertures and engage a structure in the USB connector receptacle; and an anti-tamper structure coupled between the USB shell and the articulating housing and adapted to form a stress joint that breaks the USB shell from the articulating housing in response to attempts to remove the plug in absence of proper unlocking.

13. The apparatus according to claim 6 further comprising:

a computer comprising:

a housing;

at least one electronic component contained within the housing, the at least one electronic component including at least one processor:

a Universal Serial Bus (USB) interface coupled to the at least one electronic component; and at least one Universal Serial Bus (USB) connector receptacle adapted to receive respective at least one USB electrical connector.

* * * * *